United States Patent [19]

Kachlic

[11] Patent Number: 5,024,607

[45] Date of Patent: Jun. 18, 1991

[54] GROUNDING ELECTRICAL CONNECTOR

[75] Inventor: Jerry D. Kachlic, Clementi Park, Singapore

[73] Assignee: Molex Incorporated, Lisle, Ill.

[21] Appl. No.: 537,735

[22] Filed: Jun. 14, 1990

[51] Int. Cl.[5] ..... H01R 13/73

[52] U.S. Cl. ..... 439/567; 439/554; 439/108

[58] Field of Search ..... 439/557, 567, 607, 82, 439/83, 108, 873, 558, 554, 571, 92

[56] References Cited

U.S. PATENT DOCUMENTS

| | | | |
|---|---|---|---|
| 2,627,385 | 2/1953 | Tinnerman | 439/557 |
| 4,639,066 | 1/1987 | Shimamiya et al. | 439/83 |
| 4,721,473 | 1/1988 | DelGuidice et al. | 439/554 |
| 4,842,552 | 6/1989 | Frantz | 439/557 |
| 4,938,704 | 7/1990 | Fujiura | 439/607 |
| 4,943,244 | 7/1990 | Teck et al. | 439/567 |

*Primary Examiner*—Gary F. Paumen

*Attorney, Agent, or Firm*—Louis A. Hecht; Stephen Z. Weiss; A. A. Tirva

[57] ABSTRACT

An electrical connector is disclosed for mounting to a substrate such as a printed circuit board. The connector includes an insulating housing having a peripheral flange defining a front face. A conductive shield is positionable against the front face of the housing. A conductive board lock member is positionable on the housing for commoning the conductive shield to a ground trace on the printed circuit board. The board lock member includes a body portion and a pair of legs positionable through a locking hole in the printed circuit board. One of the legs is bent from an end edge of the body portion, and the other leg is bent out of an opening in the body portion. A method is disclosed for stamping and forming the conductive board lock member out of sheet metal material.

11 Claims, 1 Drawing Sheet

FIG.1
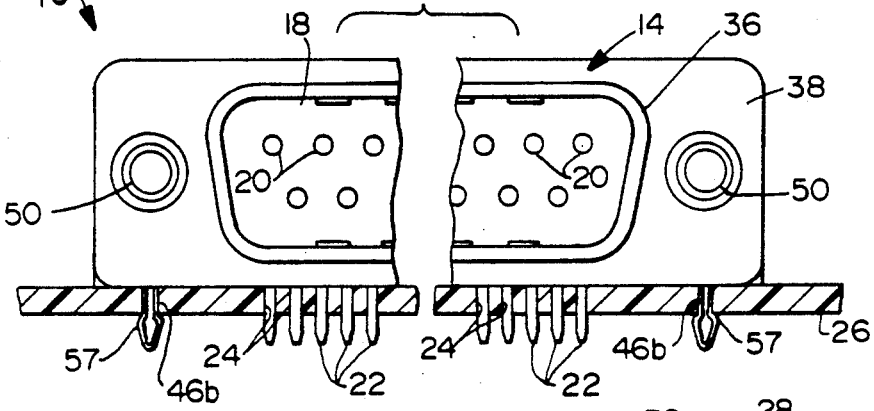
FIG.2
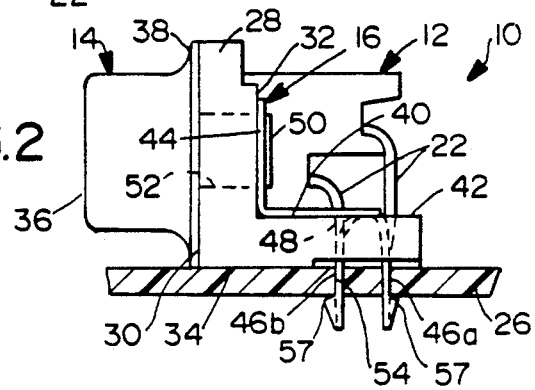
FIG.3
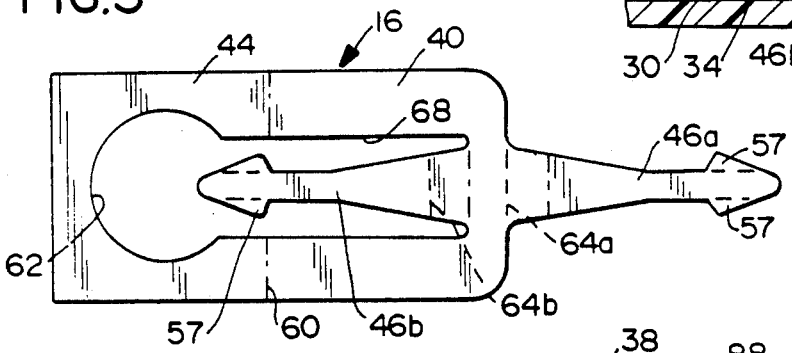
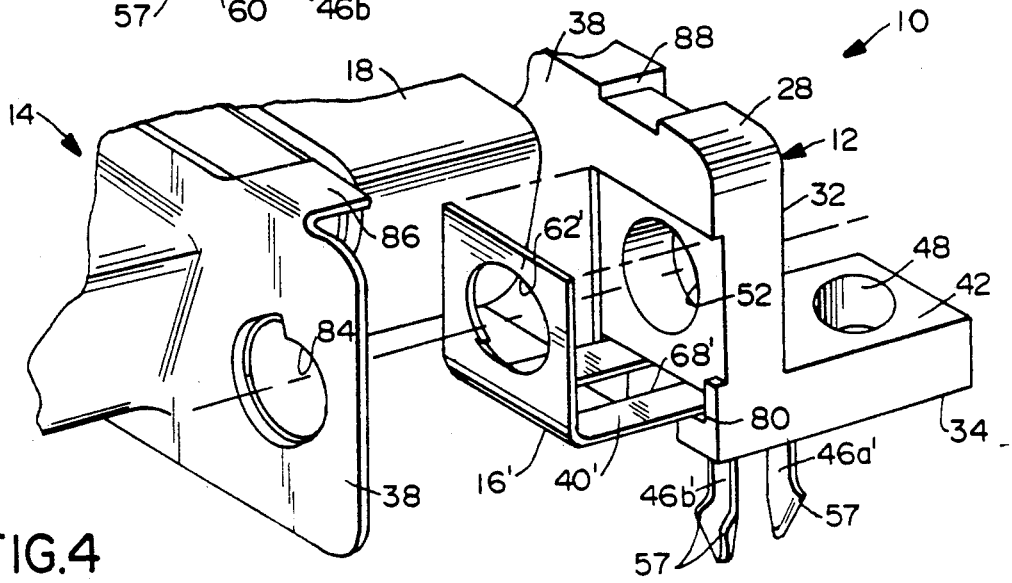
FIG.4

GROUNDING ELECTRICAL CONNECTOR

FIELD OF THE INVENTION

This invention generally relates to electrical connectors and, particularly, to an electrical connector mounted to a substrate such as a printed circuit board for grounding and locking thereto, and further to a stamped and formed conductive board lock member for the connector.

BACKGROUND OF THE INVENTION

In the electronics industry, electrical connectors are mounted to printed circuit boards, such as by right angled mounting, for electrical connection to circuit traces on the boards. Typically, the electrical connectors are imprinted onto the printed circuit boards by automated methods, and the electrical connections are wave soldered to the circuits on the boards. The connectors usually include some form of locking or retention feature to hold the connectors to the boards and, in addition, the connectors include a commoning feature to ground a shield or other component of the connector to a ground trace on the board, often by insertion of a commoning element through a hole of the printed circuit board.

One type of electrical connector of the character described above is known in the electrical connector industry as a miniature or sub-miniature D connector. The connector includes a plug and a receptacle, each having an insulative housing containing a plurality of mating terminals or contacts. In order to shield against RF/EM interference, an exterior metal or conductive shell typically encloses the housing The shielding shell is effectively grounded to the ground traces on the printed circuit board.

Often, the locking or retention feature and the commoning feature to ground the shielding shell are provided by a one-piece or multi-piece stamped and formed sheet metal board lock member. The member includes a body portion and depending leg means positionable through a locking hole in the printed circuit board. The leg means both lock the connector to the board and establish a grounding connection for commoning the shielding shell to the ground traces on the printed circuit board. It has become popular to form the leg means by a pair of legs which can exert opposing forces within the hole in the printed circuit board to provide for good retention. The legs may have locking hooks for locking beneath the bottom surface of the printed circuit board.

One of the problems with providing a conductive board lock member with a plurality of locking legs, such as the opposing pair of legs described above, is that there is a considerable loss of metal during the stamping and forming process of the board lock member. For instance, in a stamped blank form, the legs may project outwardly from the body portion of the board lock member, and the legs then are bent at an angle to the body so that they can be inserted through the hole in the printed circuit board. The body may be a fairly narrow portion of the board lock member, but the projecting legs, prior to being bent or formed, take up a considerable area of the sheet metal material, resulting in considerable waste. This invention is directed to solving these problems by providing a novel configuration of a board lock member having a pair of locking legs for insertion through a hole in the printed circuit board.

SUMMARY OF THE INVENTION

An object, therefore, of the invention is to provide an electrical connector for mounting to a substrate such as a printed circuit board, and particularly to a novel conductive board lock member for locking the connector to the printed circuit board and grounding a conductive shield of the connector.

In the exemplary embodiment of the invention, the electrical connector includes an insulating housing having a peripheral flange defining a front face. A conductive shield is positionable against the front face of the housing. A conductive board lock member is positionable on the housing for commoning the conductive shield to a ground trace on the printed circuit board. The board lock member includes a body portion and a pair of legs positionable through a locking hole in the printed circuit board. One of the legs is bent from an end edge of the body portion, and the other of the legs is bent out of an opening in the body portion. Consequently, the entire conductive board lock member can be stamped and formed in a configuration whereby both legs extend longitudinally of the stamped body which is formed into the ultimate configuration of the board lock member.

As disclosed herein, the legs are oppositely curved in cross-section to present convex surfaces facing each other. The legs can apply opposing forces within the hole in the printed circuit board, and the curve shape of the legs rigidify the legs, all for providing an excellent retention feature for the connector. The legs also include hook means for locking beneath the bottom surface of the printed circuit board.

Other objects, features, and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

FIG. 1 is a fragmented front elevational view of an electrical connector embodying the concepts of the invention;

FIG. 2 is an end or side elevational view of the connector of FIG. 1;

FIG. 3 is a plan view of a stamped blank for forming the conductive board lock member for the connector of FIGS. 1 and 2; and FIG. 4 is a fragmented, exploded perspective view of an electrical connector embodying a modified version of the conductive board lock member.

DETAILED DESCRIPTION OF THE PREFERRED EMBODIMENT

Referring to the drawings in greater detail, and first to FIGS. 1 and 2, the invention is illustrated as embodied in a miniature or sub-miniature D connector, generally designated 10. The connector is of generally conventional configuration and includes a unitary insulating housing, generally designated 12 (FIG. 2), a conductive shield, generally designated 14, and a pair of conductive board lock members, one of which is best shown in FIG. 2 and generally designated 16.

Insulating housing 12 includes a D-shaped body portion 18 (FIG. 1) having a plurality of terminal passages 20 for receiving appropriate electrical terminals with mating portions in the passages for receiving appropriate electrical terminals of a mating connector (not shown). The terminals have solder tail portions 22 (FIG. 1) for insertion through holes 24 in a printed circuit board 26 for establishing connection with circuit traces on the printed circuit board, as is known. A peripheral flange 28 (FIG. 2) of housing 12 surrounds D-shaped body portion 18 and forms a front face 30 and a rear face 32 (FIG. 2). The housing also has a bottom face 34 for positioning onto the top of printed circuit board 26.

Conductive shield 14 has a shroud portion 36 and an integral peripheral flange 38. Shroud 36 surrounds body portion 18 of housing 12, and peripheral flange 38 abuts front face 30 of peripheral flange 28 of the housing.

Housing 12 is fabricated of dielectric material, such as plastic, and conductive shield 14 is a stamped and formed metal member, with shroud 36 produced through a deep draw process.

There are a pair of conductive board lock members 16 at opposite ends of the connector. Each board lock member includes a body portion 40 (FIG. 2) for seating on top of a surface 42 of housing 12, an upstanding arm 44 positionable against rear face 32 of the housing, and a pair of locking legs **46*a* and 46*b* extending through a bore 48 in the housing. Upstanding arm 44 has a hole (illustrated hereinafter) for receiving an appropriate conductive rivet 50 for commoning the conductive board lock member to flange 38 of conductive shield 14, through a hole 52 (FIG. 2) in flange 28 of the housing. Locking legs 46*a*, 46*b* extend through a hole 54 in printed circuit board 26 for grounding to a ground trace on the printed circuit board and for commoning the ground trace to conductive shield 14. The locking legs have hook portions 57 for locking beneath the bottom of the printed circuit board. As shown in FIGS. 1 and 2, the legs are oppositely curved in cross-section to present convex surfaces facing each other. This rigidifies the legs, which, as stated, are fabricated of sheet metal material. The inherent resiliency of the formed legs, along with hook portions 57 provide good retention for connector 10 on printed circuit board 26**.

FIG. 3 shows a flat metal blank illustrating how each conductive board lock member 16 is stamped out of sheet metal material, and before the member is formed into the shape described in relation to FIGS. 1 and 2. More particularly, the location of body portion 40 and arm 44 are shown, separated by a bend line 60 where the arm is bent at a right-angle to the body portion during the forming process of the board lock member. A hole 62 is stamped out of arm 44 and through which rivet 50 extends for establishing conductivity between the board lock member and shield 14, as described above. Legs **46*a* and 46*b* are bent in the forming process at right angles to body portion 40, opposite the bent direction of arm 44, as indicated by bend lines 64*a* and 64*b*, respectively. Hooks 57 are shown projecting laterally outwardly from each leg 46*a* and 46*b*. In the forming process, the legs are curved in cross-section along their lengths as described above, to strengthen the legs and present convex surfaces facing each other. This also directs the hook portions outwardly as shown in FIGS. 1 and 2**.

It can be seen in FIG. 3 that legs **46*a* and 46*b* are stamped in-line with the elongated configuration of body portion 40 and arm 44. This is accomplished, as shown, by stamping leg 46*a* so that it projects from one end 66 of body portion 40. The other leg 46*b* is stamped out of an opening 68 in the body portion 40. Therefore, it can be seen that leg 46*b* is stamped from the "interior" of body portion 40 and arm 44 just as hole 62 is stamped therefrom, resulting in a waste of material which would have to have been used from the sheet metal strip anyway. With the other leg 46*b* stamped from the end of body portion 40, it can be seen that the entire conductive board lock member 16 is stamped in a longitudinal configuration within the side dimensions of body portion 40. No other portions of the board lock member, in its stamped form, project transversely outwardly from the sides of the body portion. It can be understood that, in mass production, numbers of the board lock members can be stamped from a continuous strip, with the sides of the body portions of the board lock members located extremely close to each other lengthwise of the strip. The only lost material is that within opening 68 and hole 62, along with the material at the sides of leg 46*a***.

FIG. 4 shows an alternative design of board lock member 16' for use with an electrical connector 10 substantially identical to the electrical connector described in relation to FIGS. 1 and 2. Therefore, like numerals have been applied to like components, where applicable, described in relation to FIGS. 1 and 2. The difference is that board lock member 16 has a longer body portion 40' than body portion 40 in board lock member 16. In some instances, it is desirable to place the arm of the board lock member against front face 38 of housing 12. Therefore, body portion 40' of board lock member 16' extends through a recess 80 in the housing, and arm 44' of the board lock member seats in a shallow recess 82 in the front face of the housing. Arm 44' thereby is sandwiched between flange 38 of conductive shield 14 and the housing to establish a direct conductive engagement between the shield and the board lock member. Any appropriate fastening means can be inserted through hole 52 in housing 12, hole 62' in board lock member 16' and through a hole 84 in flange 38 of conductive shield 14. The only other difference shown in FIG. 4 versus FIGS. 1 and 2, between housing 12 and shield 14, is that integral retaining tabs 86 project rearwardly from the top edge of peripheral flange 38 of shield 14 for crimpingly engaging the top edge of peripheral flange 28 of housing 12 within a recess 88 in the top edge. Of course, these same retaining tabs could be used with the connector shown in FIGS. 1 and 2, but they are not visible in those views.

Otherwise, board lock member 16', like board lock member 16, includes curve legs **46*a'* and 46*b'*, along with hooks 57' for locking and grounding to the printed circuit board. Board lock member 16' is stamped and formed the same as described in relation to FIG. 3. In other words, leg 46*a'* is stamped from the end of body portion 40' opposite arm 44', and leg 46*b'* is stamped out of an opening 68' in the body portion of the board lock member. The only difference is that opening 68' does not "flow" into hole 62' (as shown in FIG. 3) because body portion 40' is longer in that it extends through the housing to position arm 44' against front face 38 of the housing. The same material savings is effected as described in relation to the stamping of board lock member 16 as described in relation to FIG. 3**.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector for mounting to a substrate such as a printed circuit board, comprising:

an insulating housing having a peripheral flange defining a front face;

a conductive shield positionable against the front face of the housing; and a conductive board lock member positionable on the housing for commoning the conductive shield to a ground trace on the printed circuit board, the board lock member including a body portion and a pair of legs positionable through a locking hole in the printed circuit board, one of the legs being bent form an edge of the body portion, and the other leg being bent out of an opening from another edge of said body portion defining said opening.

2. The electrical connector of claim 1 wherein said body portion includes an arm positionable against a rear side of said flange, and including conductive means extending through the flange between the arm and said shield.

3. The electrical connector of claim 1 wherein said body portion includes an arm sandwiched between the conductive shield and the front face of the housing.

4. The electrical connector of claim 3 wherein said body portion extends through the flange.

5. The electrical connector of claim 1 wherein said legs are oppositely curved in cross-section to present convex surfaces facing each other.

6. The electrical connector of claim 5, including hook means on said legs for locking beneath a bottom surface of the printed circuit board.

7. The electrical connector of claim 1 wherein said conductive board lock member comprises a stamped and formed member.

8. An electrical connector for mounting to a substrate such as a printed circuit board, comprising:

an insulating housing having a peripheral flange defining a front face;

a conductive shield positionable against the front face of the housing; and a conductive board lock member positonable on the housing for commoning the conductive shield to a ground trace on the printed circuit board, the board lock member being stamped in a longitudinal configuration from a uniform width strip of sheet metal material and formed in a generally right-angularly Z-shaped configuration including an intermediate body portion, having side dimensions defined by the width of the strip of sheet metal, an arm portion upstanding from one end of the body portion for commoning to the conductive shield and a locking leg bent out of an opening in the body portion from an edge defining said opening for positioning through a locking hole in the printed circuit board.

9. The electrical connector of claim 8 wherein said arm portion is positioned against a rear side of said flange and the connector includes conductive means extending through said flange commoning the arm portion of the board lock member with the conductive shield and wherein a second locking leg is bent from another edge of said body portion and is positioned opposite to said first locking leg.

10. The electrical connector of claim 8 wherein said upstanding arm portion of the conductive board lock member is sandwiched between the conductive shield and the front face of the housing.

11. The electrical connector of claim 10 wherein said body portion extends through the flange.

* * * * *